United States Patent [19]

Roselle

[11] Patent Number: 4,824,590

[45] Date of Patent: Apr. 25, 1989

[54] THICKENED AQUEOUS COMPOSITIONS WITH SUSPENDED SOLIDS

[75] Inventor: Brian J. Roselle, Fairfield, Ohio

[73] Assignee: The Procter & Gamble Company, Cincinnati, Ohio

[21] Appl. No.: 163,172

[22] Filed: Feb. 26, 1988

Related U.S. Application Data

[63] Continuation of Ser. No. 905,366, Sep. 8, 1986, abandoned.

[51] Int. Cl.[4] ..... C11D 7/16; C11D 7/54; C11D 11/00

[52] U.S. Cl. ..... 252/90; 252/95; 252/99; 252/135; 252/140; 252/155; 252/DIG. 14

[58] Field of Search ..... 252/95, 90, 99, 131, 252/135, 155, 140, DIG. 14, 1

[56] References Cited

U.S. PATENT DOCUMENTS

| | | | |
|---|---|---|---|
| 3,639,568 | 2/1972 | Schmitt | 424/43 |
| 4,116,851 | 9/1978 | Rupe et al. | 252/103 |
| 4,240,919 | 12/1980 | Chapman | 252/95 |
| 4,588,582 | 5/1986 | Motarjemi | 424/49 |
| 4,592,855 | 6/1986 | Gioffre et al. | 252/89.1 |
| 4,740,327 | 4/1988 | Julemont et al. | 252/103 |

FOREIGN PATENT DOCUMENTS

| | | |
|---|---|---|
| 76598 | 5/1985 | Japan . |
| 42597 | 3/1986 | Japan . |
| 164610 | 3/1986 | Japan . |
| 2116199 | 9/1983 | United Kingdom . |
| 2140451 | 11/1984 | United Kingdom . |

*Primary Examiner*—Prince E. Willis

*Attorney, Agent, or Firm*—Gretchen R. Hatfield; Robert B. Aylor; Donald E. Hasse

[57] ABSTRACT

Aqueous shear thinning compositions comprising a continuous aqueous phase and suspended solid particles are stabilized by incorporating gas in the form of very small bubbles to adjust the overall specific gravity of the composition to within from about 5% more than to about 10% less than the specific gravity of said aqueous phase.

12 Claims, No Drawings

THICKENED AQUEOUS COMPOSITIONS WITH SUSPENDED SOLIDS

This is a continuation of application Ser. No. 905,366, filed on Sept. 8, 1986, abandoned.

TECHNICAL FIELD AND BACKGROUND ART

This invention relates to aqueous liquid compositions which have a yield value and are shear-thinning comprising suspended particles having a density greater than that of the continuous aqueous liquid phase. Compositions of this type are well known, especially where the composition is a detergent composition. Examples of such compositions are disclosed in U.S. Pat. No. 3,075,922-Wixon, issued Jan. 29, 1963; U.S. Pat. No. 3,985,668-Hartman, issued Oct. 12, 1976; U.S. Pat. No. 4,116,849-Leikhim, issued Sept. 26, 1978; U.S. Pat. No. 4,116,851-Rupe et al, issued Sept. 26, 1978; U.S. Pat. No. 4,162,987-Maguire, Jr. et al, issued July 31, 1979; U.S. Pat. No. 4,431,559-Ulrich, issued Feb. 14, 1984; U.S. Pat. No. 4,511,487-Pruhs et al, issued Apr. 16, 1985; U.S. Pat. No. 4,512,908-Heile, issued Apr. 23, 1985; U.S. Pat. No. 4,561,994-Rubin et al, issued Dec. 31, 1985 and British Patent Application No. 2,116,199A-Julemont et al, published Sept. 21, 1983, all of said patents and said published application being incorporated herein by reference.

U.S. Pat. No. 3,985,668, discloses that a light water-insoluble particulate filler material is a desirable ingredient of such compositions to improve stability. Also, Japanese Patent Application J60076598-A, discloses that air bubbles 50–700 microns in diameter improve separation stability in light duty liquid compositions containing suspended abrasives.

SUMMARY OF THE INVENTION

Aqueous shear-thinning compositions having a yield value comprising: (1) solid particles suspended in a continuous aqueous liquip phase, said particles having a density greater than the continuous liquid phase; and (2) entrained gases in the form of very small bubbles in amounts to bring the overall specific gravity of the composition to within from about 5% more than to about 10% less than the specific gravity of the aqueous phase to improve the stability of the compositions with respect to avoiding separation of the formula, especially the separation of an aqueous phase without suspended solids at the top.

DETAILED DESCRIPTION OF THE INVENTION

The Aqueous Liquid

Water is the principle component of the aqueous liquid which is the continuous phase in the compositions of this invention. In addition, the aqueous liquid can contain a number of other components dissolved in the aqueous liquid. It is preferred that the water used to prepare the aqueous liquid component contain, at most, minimal amounts of dissolved impurities.

The aqueous liquid normally comprises from about 30% to about 90% by weight, preferably from about 55% to about 90% by weight of the total composition.

The Thickening Agent

Any material or materials which can be admixed with the aqueous liquid to provide shear-thinning compositions having sufficient yield values can be used in the compositions of this invention. The most common thickening agents are clays, but materials such as colloidal silica, particulate polymers, such as polystyrene and oxidized polystyrene, combinations of certain surfactants, and water soluble polymers such as polyacrylate are also known to provide yield values.

The most preferred thickening agents are naturally occurring and synthetic clays.

A preferred synthetic clay is the one disclosed in U.S. Pat. No. 3,843,548, incorporated herein by reference. Naturally occurring clays include smectites and attapulgites. These colloidal materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonoids) and attapulgites (or palygorskites).

Smectites are three-layered clays. There are two distinct classes of smectite-clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$ and $Ca^{++}$, as well as $H^+$, can be copresent in the water of hydration to provide electrical neutrality. Although the presence of iron in such clay material is preferably avoided to minimize adverse reactions, e.g., a chemical interaction between clay and bleach, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate clays have a trioctahedral crystal lattice.

The smectite clays used in the compositions herein are all commercially available. Such clays include for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from ECC America, Inc. (both montmorillonites); Volclay BC, Volclay No. 325, and especially Volcay HPM-20 from American Colloid Company, Skokie, Ill.; Black Hills Bentonite BH 450, from International Minerals and Chemicals; Veegum Pro and Veeghum F, from R. T. Vanderbilt (both hectorites); Barasym NAS-100, Barasym NAH-100, Barasym SMM 200, and Barasym LIH-200, all synthetic hectorites and saponites marketed by Baroid Division, NL, Industries, Inc.

Smectite clays are preferred for use in the instant invention. Montmorillonite, hectorite and saponite are the preferred smectites. Gelwhite GP, Barasym NAS-100, Barasym NAH-100, and HPM-20 are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as:

$$(OH_2)_4(OH)_2Mg_5Si_8O_{20}.4H_2O.$$

A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150° C.; 10.13% $H_2O$ removed at higher temperatures.

Like the smectites, attapulgite clays are commercially available. For example, such clays are marketed under the tradename Attagel, i.e. Attagel 40, Attagel 50 and Attagel 150 from Engelhard Minerals & Chemicals Corporation.

Particularly preferred for the colloid-forming clay component in certain embodiments of the instant composition are mixtures of smectite and attapulgite clays. In general, such mixed clay compositions exhibit increased and prolonged fluidity upon application of shear stress but are still adequately thickened solutions at times when flow is not desired. Clay mixtures in a smectite/attapulgite weight ratio of from 5:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example a sodium clay is one in which the absorbed cation is predominately sodium. Such absorbed cations can become involved in exchange reactions with cations present in aqueous solutions. It is preferred that the present compositions contain up to about 12% or preferably up to about 8% potassium ions since they improve the viscosity increasing characteristics of the clay. Preferably at least 1%, more preferably at least 2% of the potassium ions are present.

Hectorites can also be used, particularly those of the types described in U.S. Pat. Nos. 4,511,487 and 4,512,908, previously incorporated herein by reference.

Specific preferred clays are disclosed in U.S. Pat. Nos. 3,993,573 and 4,005,027, incorporated herein by reference. These materials are preferred for thickening. The amount of clay will normally be from about ¼ to about 20%, preferably from about 0.5% to about 12%, more preferably from about 0.5% to about 2%.

Other thickening agents which are useful in the process aspect of this invention include those disclosed in U.S. Pat. No. 3,393,153, incorporated herein by reference, including colloidal silica having a mean particle diameter ranging from about 0.01 micron to about 0.05 micron and particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples include copolymers of styrene with monomers such as maleic anhydride, nitrilonitrile, methaacrylic acid and lower alkyl esters of methacrylic acid. Other materials include copolymers of styrene with methyl or ethyl acrylate, methyl or ethyl maleate, vinyl acetate, acrylic maleic or fumaric acids and mixtures thereof. The mole ratio of ester and/or acid to styrene being in the range from about 4 to about 40 styrene units per ester and/or acid unit. The latter materials having a mean particle diameter range of from about 0.05 micron to about 1 micron and molecular weights ranging from about 500,000 to about 2,000,000.

Other preferred thickening agents include polycarboxylate polymers, e.g., polyacrylates, polymethacrylates, etc. and copolymers of such monomers with other monomers such as ethylene, etc.

Still other thickening agents useful herein are described in U.S. Pat. No. 4,226,736-Bush et al, issued Oct. 7, 1980 and incorporated herein by reference.

The compositions contain from about 0.1% to about 20%, preferably from about 0.3% to about 15%, most preferably from about 0.5% to about 5% of thickening agent.

The thickening agents are used to provide a yield value of from about 20 to about 500, preferably from about 50 to about 350, and most preferably from about 100 to about 250.

Yield Value Analysis

The yield value is an indication of the shear stress at which the gel strength is exceeded and flow is initiated. It is measured herein with a Contravis Rheomat 115 viscometer utilizing a Rheoscan 100 controller and a DIN145 spindle at 25° C. The shear rate rises linearly from 0 to 0.4 $sec^-$ over a period of 10 minutes after an initial 5 minute rest period.

The Entrained Gas

The entrained gas can be any gaseous material that is insoluble in the aqueous liquid. Air is preferred, but any gas that will not react with the composition, such as nitrogen, is also useful.

The entrained gas bubbles are preferably in very finely divided form, i.e. less than about ½ in diameter, preferably less than about 1/32 in. in diameter. They are dispersed throughout the aqueous liquid in an amount, generally from about 1% to about 20%, preferably from about 5% to about 15% by volume, to lower the specific gravity of the overall composition to within from about 5% more than to about 10% less than, preferably within from about 1% more than to about 5% less than the specific gravity of the aqueous liquid without the entrained gas. It is more desirable to be below the specific gravity of the aqueous phase. Any separation is then at the bottom of the container and pouring will tend to remix the separated phase before it is dispensed.

The gas can be admixed with high shear mixing, e.g., through a shear device that has close tolerances to achieve air bubble size reduction. High shear mixing can be attained with shear rates greater than about 1000 $sec^-$, preferably greater than about 15,000 $sec^-$, most preferably greater than 30,000 sec$^{-}$. The clay, on the other hand, should preferably be added last to minimize excessive exposure to shear in product. Each of these preferred processing steps gives compositions with superior stability. The gas can also be introduced in finely divided form by using a sparger.

The Suspended Particles

The particles herein can be any of the materials which are conventionally suspended in aqueous liquids. The particles can be insoluble abrasive particles, soluble inorganic materials such as detergent builder materials that are present in excess of their solubility in the aqueous liquid, soluble materials which are made insoluble by coating with insoluble material, etc. The invention is especially desirable for use in the preferred compositions described hereinafter.

The solid suspended material comprises from about 0% to about 50% of the composition, preferably from about 3% to about 40% of the composition, most preferably from about 5% to about 30% of the composition. The benefits of the invention are readily seen when the solid particles have a specific gravity which is about 10%, especially 50%, more especially 100% more, than the specific gravity of the aqueous liquid.

OPTIONAL INGREDIENTS

Detergent Surfactants

The compositions of this invention can contain from 0% to about 40%, preferably from about 20% to about 30%, or more preferably from about 0.2% to about 5% of detergent surfactant based upon the desired end use. The choice of detergent surfactant and amount will depend upon the end use of the product. For example, for an automatic dishwashing product the level of surfactant should be less than about 5%, preferably less than about 3%, and the detergent surfactant should be low sudsing. Desirable detergent surfactants include nonionic detergent surfactants, anionic detergent surfactants, amphoteric and zwitterionic detergent surfactants, and mixtures thereof.

Examples of nonionic surfactants include:

(1) the condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, with from about 6 to about 15 moles, preferably 7 to 12 moles, most preferably 9 moles, of ethylene oxide provides superior S/F performance. More particularly, it is desirable that the fatty alcohol contain 18 carbon atoms and be condensed with from about 7.5 to about 12, preferably about 9, moles of ethylene oxide. These various specific $C_{17}$–$C_{19}$ ethoxylates give extremely good performance even at lower levels (e.g., 2.5%–3%) and at the higher levels (>5%) are sufficiently low sudsing, especially when capped with a low molecular weight ($C_{1-5}$) acid or alcohol moiety, so as to minimize or eliminate the need for a suds-suppressing agent. Suds-supressing agents in general tend to act as a load on the composition and to hurt long term S/F characteristics.

(2) Polyethylene glycols having molecular weight of from about 1,400 to about 30,000, e.g., 20,000; 9,500; 7,500; 6,000; 4,500; 3,400; and 1,450. All of these materials are waxlike solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)_x(C_3H_6O)y\ (C_2H_4O)_xH$ where y equals at least 15 and $(C_2H_4O)_{(x+x)}$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Preferred surfactants are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Also preferred are the low sudsing compounds of (4), the other compounds of (5), and the $C_{17-19}$ materials of (1) which have a narrow ethoxy distribution.

In addition to the above mentioned surfactants, other suitable surfactants can be found in the disclosures of U.S. Pat. Nos. 3,544,473, 3,630,923, 3,888,781 and 4,001,132, all of which are incorporated herein by reference.

When the composition contains a hypochlorite bleach it is preferably that the detergent surfactant is bleach stable. Such surfactants desirably contain no functions, such as unsaturation, some aromatic structures, amide, aldehydic, methyl keto or hydroxyl groups which are susceptible to oxidation by the hypochlorite.

Bleach-stable surfactants which are especially resistant to hypochlorite oxidation fall into two main groups. One such class of bleach-stable surfactants are the water-soluble alkyl sulfates and/or sulfonates, containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristly alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl suflate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, postassium lauryl alkyl sulfate and sodium lauryl alkyl sulfate.

A second class of bleach-stable surfactant materials operable in the instant invention are the water-soluble betaine surfactants. These materials have the general formula:

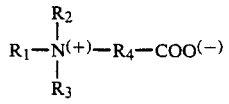

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Other desirable bleach stable surfactants are the alkyl phosphonates, taught in U.S. Pat. No. 4,105,573, of Ronald L. Jacobsen, issued Aug. 8, 1978, incorporated herein by reference.

Still other preferred bleach stable surfactants and compositions containing said surfactants including Dowfax 3B2 and similar surfactants are disclosed in published U.K. Patent Application Nos. 2,163,447A; 2,163,448A; and 2,164,350A, said applications being incorporated herein by reference.

Bleaching Agent

The instant compositions optionally and desirably include a bleaching agent. Any suitable bleaching agent and especially those that yield active chlorine or active oxygen in aqueous solution can be employed.

A highly preferred bleaching agent is one which yields a hypochlorite species in aqueous solution. The hypochlorite ion is chemically represented by the formula $OCl^-$. The hypochlorite ion is a strong oxidizing agent and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e. one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, postassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding beaching agents are available in solid or concentrated form and are dissolved in water during preparation of the compositions of the instant invention. Some of the above materials are available as aqueous solutions.

If present, the above-described bleaching agents are dissolved in the aqueous liquid component used to form the false body fluid phase. Bleaching agents can provide from about 0.1% to 10% available chlorine by weight, preferably from about 0.5% to 2.0% available chlorine by weight, of the total composition.

Buffering Agent

Especially when the instant compositions contain such optional ingredients as bleach and surfactant, it is generally desirable to also include one or more buffering agents capable of maintaining the pH of the instant compositions within the alkaline range. It is in this pH range that optimum performance of the bleach and surfactant are realized, and it is also within this pH range wherein optimum composition chemical stability is achieved.

When the essential thickening agent is a clay material and when a hypochlorite bleach is optionally included in the instant compositions maintenance of the composition pH within the 10.5 to 12.5 range minimizes undesirable chemical decomposition of the active chlorine, hypochlorite-yielding beaching agents, said decomposition generally being encountered when such bleaching agents are admixed with clay in unbuffered aqueous solution. Maintenance of this particular pH range also minimizes the chemical interaction between the strong hypochlorite bleach and the surfactant compounds optionally present in the instant compositions. Finally, as noted, high pH values such as those maintained by an optional buffering agent serve to enhance the soil and stain removal properties of the surfactant during utilization of the present compositions.

Any compatible material or mixture of materials which has the effect of maintaining composition pH within the alkaline pH range, and preferably within the 10.5 to 12.5 range, can be utilized as the optional buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, tetrapotassium pyrophosphate, tripotassium phosphate, trisodium phosphate, anhydrous sodium tetraborate, sodium tetraborate pentahydrate and sodium tetraborate decahydrate. Preferred buffering agents for use herein include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/metasilicate weight ratio of about 3:1.

As discussed hereinbefore and hereinafter, it is also highly preferred to include in the instant compositions a material which acts as a detergency builder, i.e. a material which reduces the free calcium and/or magnesium ion concentration in a surfactant-containing aqueous solution. Some of the above-described buffering agent materials additionally serve as builder materials. Such compounds as the alkali metal carbonates, phosphates, tripolyphosphates and pyrophosphates are of this type. Other buffering agent components such as the silicates and tetraborates perform no appreciable calcium control function.

Since presence of a builder in the instant compositions is highly desirable, it is preferred that the optional buffering agent contain at least one compound capable of additionally acting as a builder, i.e. capable of lowering the free calcium and/or magnesium ion content of an aqueous solution containing such ions.

If present, the above-described buffering agent materials are dissolved in the aqueous liquid component. Buffering agents can generally comprise from about 2% to 15% by weight, preferably from about 5% to 8% by weight, of the total composition.

Other Optional Materials

In addition to the above-described bleach, surfactant and buffering agent optional components, the instant compositions can contain other non-essential materials to enhance their performance, stability, or aesthetic appeal. Such materials include optional nonbuffering builder compounds, coloring agents and perfumes. Although, as noted above, some of the above-described buffering agents can function as builder compounds, it is possible to add other builder compounds which either alone or in combination with other salts do not buffer within the preferred pH range. Typical of these optional builder compounds which do not necessarily buffer within the highly preferred 10.5–12.5 pH range are certain hexametaphosphates and polyphosphates. Specific examples of such optional builder materials include sodium tripolyphosphate, potassium tripolyphosphate and potassium hexametaphosphate.

Conventional coloring agents and perfumes can also be added to the instant compositions to enhance their aesthetic appeal and/or consumer acceptability. These materials should, of course, be those dye and perfume varieties which are especially stable against degradation by strong active chlorine bleaching agents if such bleaching agents are also present.

If present, the above-described other optional materials generally comprise no more than about 35% by weight of the total composition and are dissolved, suspended or emulsified in the aqueous liquid component used to form the false body fluid phase of the instant compositions.

Preferred Composition

Preferred compositions of this invention are liquid automatic dishwasher compositions comprising:

(1) from about 0% to about 5%, preferably from about 0.2% to about 2% of a bleach-stable low foaming detergent surfactant;

(2) from about 10% to about 40%, preferably from about 20% to about 30% of a detergency builder, especially builders selected from the group consisting of sodium tripolyphosphate, sodium carbonate, a potassium pyrophosphate, and mixtures thereof;

(3) a hypochlorite bleach to yield available chlorine in an amount of from about 0.3% to about 2.5%, preferably from about 0.5% to about 1.5%;

(4) from about 0.1% to about 10%, preferably from about 0.5% to about 5% of a clay thickening agent; and (5) the balance a continuous phase of aqueous liquid, said composition having:

(a) a yield value of from about 20 to about 500 dynes/cm$^2$, preferably from about 100 to about 300 dynes/cm$^2$;

(b) from about 10% to about 40%, preferably from about 15% to about 30% of said detergency builder, preferably sodium tripolyphosphate, in the form of undissolved particles having a particle size range of from about 2 microns to about 500 microns, preferably from about 10 microns to about 100 microns; and (c) from about 1% to about 20%, preferably from about 5% to about 15% of entrained gas bubbles having a maximum diameter of less than about $\frac{1}{8}$", said gas preferably being selected from the group consisting of air, nitrogen, $CO_2$, $O_2$, and He in an amount to adjust the overall specific gravity of the composition to within from about 5% more than to from about 10% less than, preferably within from about 1% more than to about 5% less than the specific gravity of the aqueous liquid by itself.

The separation that occurs in these preferred compositions without the gas is a separate liquid phase, unlike the prior art compositions where the solids separated. Accordingly, it is surprising that the gas also minimizes/stops the separation of the liquid. It is surprising that within certain very critical limits that gas is so very effective.

The Process For Preparation

Simple mixing procedures are used to prepare the compositions of this invention. However, order of addition is important and the degree of mixing is also important. As stated hereinbefore, the gas can be admixed, e.g., by use of high shear mixing, i.e., with shear rates greater than about 1000 $sec^{-1}$, preferably greater than about 15,000 $sec^{-1}$. The clay, on the other hand, should be added last with only enough low shear mixing to ensure homogeneity. Each of these preferred processing steps gives compositions with superior stability.

All parts, percentages and ratios herein are by weight unless otherwise specified.

EXAMPLES

In all of the following examples, the composition was as follows:

| | % |
|---|---|
| Sodium tripolyphosphate (anhydrous basis) | 23.4 |
| Sodium silicate (2.4R) | 7.0 |
| Sodium carbonate | 6.0 |
| Available chlorine from sodium hypochlorite | 1.4 |
| Clay (Volclay HPM-20) | ~1.0 (±20%) |
| Sodium Hydroxide | ~0.7 |
| Monostearyl Acid Phosphate | ~0.03 |
| Anionic Surfactant (Dowax 3B2) | ~0.4 |
| Minor Ingredients and Water | Balance |

In the following examples air was mixed in to give the indicated initial specific gravities and the product was stored for six weeks at the indicated temperatures. The aqueous portion of the products had a specific gravity of about 1.27. The amount of separated product at the top is given in milliliters per sixty ounces, 60 oz. = 1.7 kilograms (Ml., per 60 oz.) of product although some of the samples were different sizes, as indicated.

| Example | Sample Size | Product Specific Gravity | Ml. of Separation/ 60 oz. of product 70° F. | 100° F. | 120° F. |
|---|---|---|---|---|---|
| 1* | 60 | 1.35 | 157 | 205 | 235 |
| 2* | 60 | 1.37 | 155 | 188 | 255 |
| 3* | 60 | 1.34 | 125 | 168 | 212 |
| 4* | 60 | 1.37 | 158 | 192 | 278 |
| 5* | 60 | 1.33 | 105 | 155 | 202 |
| 6 | 60 | 1.26 | <5 | 62 | 18 |
| 7 | 60 | 1.15 | 0 | 0 | 0 |
| 8 | 60 | 1.28 | 65 | 62 | 150 |
| 9 | 60 | 1.25 | 28 | 72 | 45 |
| 10* | 60 | 1.32 | 110 | 130 | 242 |
| 11 | 60 | 1.28 | 25 | 90 | 132 |
| 12 | 60 | 1.28 | 32 | 58 | 120 |
| 13 | 60 | 1.30 | 62 | 98 | 187 |
| 14* | 40 | 1.32 | 135 | 158 | 195 |
| 15 | 40 | 1.28 | 45 | 68 | 123 |
| 16* | 40 | 1.33 | 90 | 135 | 150 |
| 17* | 40 | 1.35 | 150 | 195 | 240 |
| 18* | 40 | 1.33 | 135 | 158 | 195 |
| 19* | 40 | 1.33 | 135 | 172.5 | 218 |
| 20 | 40 | 1.29 | 75 | 135 | 195 |
| 21* | 40 | 1.33 | 150 | 190 | 240 |
| 22* | 60 | 1.31 | 140 | 175 | 235 |
| 23* | 60 | 1.34 | 150 | 210 | 267 |
| 24* | 60 | 1.32 | 85 | 122 | 165 |
| 25 | 60 | 1.29 | 70 | 115 | 155 |
| 26 | 60 | 1.28 | 55 | 135 | 192 |
| 27 | 60 | 1.30 | 45 | 100 | 160 |
| 28 | 60 | 1.29 | 30 | 78 | 150 |
| 29* | 60 | 1.32 | 110 | 118 | 230 |

-continued

| Example | Sample Size | Product Specific Gravity | Ml. of Separation/ 60 oz. of product 70° F. | 100° F. | 120° F. |
|---|---|---|---|---|---|
| 30* | 80 | 1.32 | 112 | 150 | — |
| 31 | 80 | 1.30 | 98 | 84 | 185 |
| 32 | 80 | 1.29 | 66 | 79 | 155 |
| 33* | 80 | 1.33 | 90 | 135 | 214 |
| 34* | 80 | 1.31 | 75 | 94 | 178 |
| 35 | 80 | 1.28 | <5 | 28 | 60 |
| 36* | 80 | 1.32 | 54 | 109 | 158 |
| 37 | 80 | 1.26 | <5 | <5 | 82 |
| 38* | 80 | 1.31 | 46 | 112 | 189 |
| 39 | 80 | 1.27 | 8 | 8 | <5 |
| 40 | 80 | 1.27 | <5 | <5 | — |
| 41 | 80 | 1.26 | <5 | 11 | 41 |
| 42 | 80 | 1.25 | 0 | 8 | 8 |
| 43 | 60 | 1.25 | 0 | <5 | <5 |
| 44 | 60 | 1.27 | 10 | 60 | 7 |
| 45 | 80 | 1.26 | <5 | 8 | <5 |
| 46 | 80 | 1.26 | 19 | 9 | 13 |
| 47 | 80 | 1.22 | 0 | 0 | 5 |
| 48** | 80 | 1.26 | <5 | 15 | 130 |
| 49* | 80 | 1.31 | 160 | 175 | 278 |

*Comparative Examples

**Separating crystals, indicating solids formed after preparation of the suspension.

What is claimed is:

1. An aqueous liquid, shear-thinning automatic dishwashing detergent composition comprising:

(1) from 0% to about 3% of bleach-stable, low foaming detergent surfactant;

(2) from about 10% to about 40% of detergency builder;

(3) hypochlorite bleach to yield available chlorine in an amount of from about 0.3% to about 2.5%;

(4) from about 0.1% to about 10% of thickening agent; and (5) the balance a continuous phase of aqueous liquid, said composition having:

(a) a yield value of from about 20 to about 500 dynes/$cm^2$;

(b) from about 10% to about 40% of said detergency builder in the form of solid suspended particles which do not dissolve in said continuous aqueous liquid phase, which have a density greater than that of the continuous liquid phase, and which have a particle size range of from about 2 microns to about 500 microns; and (c) entrained gas selected from the group consisting of air, nitrogen, carbon dioxide, oxygen, helium, and mixtures thereof, in the form of bubbles having a maximum diameter of less than about ⅛ inch, in an amount to adjust the overall specific gravity of the composition to within from about 3% more than to about 10% less than the specific gravity of the aqueous liquid by itself.

2. The composition of claim 1 wherein the entrained gas adjusts the overall specific gravity of the composition to within from about 1% more than to about 5% less than the specific gravity of the aqueous liquid phase.

3. The composition of claim 1 wherein the specific gravity of the total composition is within about 1% more than to about 5% less than the specific gravity of the continuous aqueous liquid phase.

4. The composition of claim 1 containing from about 0.2% to about 2% of said bleach-stable low foaming detergent surfactant; from about 20% to about 30% of a detergency builder selected from the group consisting of sodium tripolyphosphate, sodium carbonate, and potassium pyrophosphate and mixtures thereof; from about 0.5% to about 1.5% available chlorine from an alkali metal hypochlorite bleach; from about 0.5% to about 5% of clay thickening agent, said composition having a yield value of from about 100 to about 300 dynes/cm$^2$, from about 15% to about 30% of the detergency builder being in the form of undissolved particles having a paticle size range of from about 10 microns to about 100 microns, and from about 5 to about 15% of said entrained gas bubbles.

5. The composition of claim 4 wherein the gas is present in an amount to adjust the overall specific gravity of the composition to within about 1% more than to about 5% less than the specific gravity of the aqueous liquid by itself.

6. The process of preparing the composition of claim 4 wherein the gas is incorporated by the use of high shear mixing with shear rates greater than about 1,000 sec$^{-1}$.

7. The process of claim 6 wherein the shear rate is greater than about 15,000 sec$^{-1}$.

8. The process of claim 7 wherein the clay is added last with only low shear mixing to ensure homogeneity.

9. The process of claim 6 wherein the clay is added last with only sufficient low shear mixing to ensure homogeneity.

10. The process of preparing the composition of claim 4 wherein the gas is added to the remainder of the composition using a sparger.

11. The process of claim 10 wherein the bubbles are less than ⅛ inch in diameter.

12. The process of claim 11 wherein the entrained gas is air.

* * * * *